US009068801B1

(12) United States Patent
Stecher, Jr. et al.

(10) Patent No.: US 9,068,801 B1
(45) Date of Patent: Jun. 30, 2015

(54) OPTICS ASSEMBLY WITH A BASE WITH A PLATFORM AND REMOVABLE AND INTERCHANGEABLE MODULES

(71) Applicants: Frederick William James Stecher, Jr., New Lisbon, WI (US); Cary Frank Winch, Necedah, WI (US)

(72) Inventors: Frederick William James Stecher, Jr., New Lisbon, WI (US); Cary Frank Winch, Necedah, WI (US)

( * ) Notice: Subject to any disclaimer, the term of this patent is extended or adjusted under 35 U.S.C. 154(b) by 0 days.

(21) Appl. No.: 14/020,476

(22) Filed: Sep. 6, 2013

Related U.S. Application Data

(60) Provisional application No. 61/699,541, filed on Sep. 11, 2012.

(51) Int. Cl.
*F41G 11/00* (2006.01)

(52) U.S. Cl.
CPC ..... *F41G 11/00* (2013.01); *F41G 11/004* (2013.01)

(58) Field of Classification Search
CPC ..... F41G 1/00; F41G 1/06; F41G 1/16; F41G 1/38; F41G 1/387; F41G 11/00–11/007
USPC ..... 42/85, 90, 111, 124, 148
See application file for complete search history.

(56) References Cited

U.S. PATENT DOCUMENTS

| | | | | |
|---|---|---|---|---|
| 4,628,611 | A * | 12/1986 | Ruffino | 42/137 |
| 4,756,111 | A * | 7/1988 | Lapier | 42/128 |
| D367,312 | S | 2/1996 | Martel | |
| 5,522,166 | A | 6/1996 | Martel | |
| 5,595,011 | A | 1/1997 | Gorslin | |
| 6,381,895 | B1 * | 5/2002 | Keeney et al. | 42/124 |
| 6,421,946 | B1 | 7/2002 | LoRocco | |
| 6,449,893 | B2 | 9/2002 | Spinner | |
| 6,508,027 | B1 | 1/2003 | Kim | |
| 6,792,711 | B2 | 9/2004 | Battaglia | |
| 6,826,864 | B1 | 12/2004 | Houtsma | |
| 6,854,206 | B2 | 2/2005 | Oz | |
| 6,922,934 | B1 | 8/2005 | Huan | |
| 7,062,876 | B2 | 6/2006 | Wilson | |
| 7,458,179 | B2 | 12/2008 | Swan | |
| 7,530,192 | B2 | 5/2009 | Grauslys et al. | |
| 7,634,866 | B2 * | 12/2009 | Javorsky | 42/111 |
| 7,685,758 | B2 | 3/2010 | Romer | |
| 7,707,762 | B1 | 5/2010 | Swan | |
| 7,730,655 | B2 | 6/2010 | Spuhr | |
| 7,743,547 | B2 | 6/2010 | Houde-Walter | |

(Continued)

OTHER PUBLICATIONS

Aidank, "AK-47 Larger Submission", Apr. 8, 2007, http://aidank.deviantart.com/art/AK-47-Larger-Submission-52750286.*

*Primary Examiner* — Bret Hayes
*Assistant Examiner* — Derrick Morgan
(74) *Attorney, Agent, or Firm* — Brannen Law Office, LLC

(57) ABSTRACT

The present invention relates to an optics assembly having a platform and removable and interchangeable modules, and in particular to an optics assembly for a Kalashnikov style firearm. In one embodiment, the assembly has two ends with a longitudinal axis there between. The base replaces the rear sight tower of the Kalashnikov style firearm. The base has a platform with edges overhanging relieved areas or slots. The base has a head with holes there through. Modules can be removably received upon the base. Each module has at least one mount for supporting an optic. Each module has ears that straddle the base head. The ears have holes that are alignable with the head holes for receiving a pin. The modules have ribs that are received within slots in the base as the module is slid along the longitudinal axis relative the base.

15 Claims, 10 Drawing Sheets

(56) References Cited

U.S. PATENT DOCUMENTS

| | | | | |
|---|---|---|---|---|
| 7,765,730 | B2 | 8/2010 | Keng | |
| 7,900,390 | B2 | 3/2011 | Moody et al. | |
| 7,941,959 | B1 | 5/2011 | Swan | |
| 7,971,384 | B2 | 7/2011 | Lippard | |
| 8,028,456 | B2 | 10/2011 | Peterson | |
| 8,091,265 | B1 | 1/2012 | Teetzel et al. | |
| 8,099,897 | B2 | 1/2012 | Elpedes et al. | |
| 8,104,218 | B2 | 1/2012 | McCann | |
| D654,134 | S * | 2/2012 | Edge et al. | D22/108 |
| 8,127,485 | B2 | 3/2012 | Moore et al. | |
| 8,141,289 | B2 | 3/2012 | Gomez et al. | |
| 8,146,283 | B2 | 4/2012 | Genes et al. | |
| 8,156,678 | B2 | 4/2012 | Hoel et al. | |
| D659,220 | S | 5/2012 | Foltz | |
| 8,316,569 | B1 * | 11/2012 | Chvala | 42/90 |
| 2005/0039369 | A1 * | 2/2005 | Wilson | 42/124 |
| 2005/0217161 | A1 * | 10/2005 | Haugen et al. | 42/124 |
| 2009/0019758 | A1 * | 1/2009 | Baugher | 42/111 |
| 2009/0113778 | A1 * | 5/2009 | Paterson | 42/90 |
| 2010/0263256 | A1 * | 10/2010 | Spinelli | 42/124 |
| 2010/0275497 | A1 | 11/2010 | Brentzel | |
| 2012/0085014 | A1 * | 4/2012 | Riley et al. | 42/115 |
| 2012/0131838 | A1 * | 5/2012 | Edge et al. | 42/90 |
| 2013/0219766 | A1 * | 8/2013 | Lee | 42/90 |
| 2014/0150325 | A1 * | 6/2014 | Keng et al. | 42/118 |

* cited by examiner

OPTICS ASSEMBLY WITH A BASE WITH A PLATFORM AND REMOVABLE AND INTERCHANGEABLE MODULES

This U.S. utility patent application claims priority on and the benefit of provisional application 61/699,541 filed Sep. 11, 2012, the entire contents of which are hereby incorporated herein by reference.

BACKGROUND OF THE INVENTION

1. Field of the Invention

The present invention relates to an optics assembly having a base with a platform and removable and interchangeable modules, and in particular to an optics assembly for a Kalashnikov style firearm.

2. Description of the Related Art

There are many aftermarket optics that can be used with existing firearms. Some firearms are designed for interchangeable optics. Others are retrofitted. In either case, optic mounts are required in order to support the optics.

Some exemplary patents are:

U.S. Pat. No. Des. 36,312 (hereafter, "USPN") to Martel is titled Combined Receiver Cover and Scope Mount.

U.S. Pat. No. 6,421,946 to LoRocco is titled Removable Sight Assembly for Weapons. It shows that an inner sleeve is pressed, when installed on a weapon, between a feature of the weapon such as a rib, rail, or barrel, and an outer sleeve. An aiming indicia is mounted on the outer sleeve.

U.S. Pat. No. 6,449,893 to Spinner is titled Mounting Apparatus. It illustrates a mounting apparatus for attaching a sighting device onto a weapon. The mounting apparatus has a rail disposed on part of the weapon in a longitudinal direction. The rail has a pair of longitudinally extending opposed sides and a longitudinally extending first attachment element on each of the opposed sides. A removable mounting base has a pair of longitudinally extending side edges and a longitudinally extending second attachment element on each side edge. Each second attachment element is complimentary to a corresponding one of the first attachment elements. The mounting base is slidingly and longitudinally engaged with the rail via the complimentary first and second attachment elements. The mounting base is formed of at least two parts which are slidable against one another in a transverse direction. A spring mechanism produces a spring force and is arranged to bias the two parts of the mounting base into engagement with the rail. The spring force is overcome by manually squeezing the two parts to release the mounting base from the rail.

U.S. Pat. No. 6,922,934 to Huan is titled Mounting Bracket for Scope of a Gun. It shows a mounting bracket for a scope of a gun is disclosed. The mounting bracket is used to mount night scopes or telescopic scopes onto the barrel of a gun rapidly. The bracket comprises a seat body having a securing jaw, an actuating jaw and a triggering block, and the actuating jaw is pivotally mounted at the seat body and, together with the securing jaw, correspondingly grips the barrel of the gun. Further, the triggering block is pivotally mounted at the seat body, and the triggering block correspondingly urges or releases the actuating jaw. The user can rapidly disassemble the mounting bracket and the barrel of the gun. The direction of action of the triggering block is perpendicularly intersected with the vibration direction of the barrel and therefore the mounting bracket will not be dislocated in the course of shooting.

U.S. Pat. No. 7,062,876 to Wilson is titled Rifle Scope Mounting Means. It shows a sight base useful to render military-style rifles equipped with battle sights to be retrofitted with telescopic rifle scopes. Use of a device according to the invention provides sporting use and accuracy to rifles originally conceived as weapons of war, in a quick and convenient method. A sight base according to the invention is readily attached and detached from a rifle, and provides surprising accuracy owing to the rigid means by which a scope may be affixed to a rifle through use of the scope base provided herein.

U.S. Pat. No. 7,634,866 to Javorsky is titled Gun Site Having Removable Adjustable Modules. It illustrates a gun sight including a lens through which a target may be viewed and a light source for directing a point of light toward the lens, the point of light being reflected by the lens toward the viewer. The location of the reflected point of light with respect to the viewer along both windage and elevation axis is adjustable, and elevation and windage modules for permitting the adjustments are removable from the remainder of the gun sight without disturbing the adjusted and windage elevation settings.

U.S. Pat. No. 7,730,655 to Spuhr is titled Sight Mount for Fire Arms. It shows a sight mount for fire arms comprises a base part to be mounted on a fire arm, and an upper part to have a sight mounted thereon. The upper part is pivoted relative to the base part for movement about an axis between a first position corresponding to the operative position of the sight, wherein a projection on the, upper part or the base part engages a groove on the other part, and a second position transverse to the first position, wherein the projection is disengaged from the groove to allow the upper part to be separated from the base part. A latch is spring biased to an engaged position preventing pivoting of the upper part, and against the spring bias can be brought into a disengaged position allowing pivoting of the upper part.

While each of these patents may show products that work well for their intended purposes, none anticipate or render the present invention obvious.

For example, none are adapted for use with a Kalashnikov style firearm.

Specifically, the dust cover and receiver on the Kalashnikov style firearm is made of sheet metal and lacks structural strength and rigidity. In this regard, the dust cover makes for a poor structure upon which to support a mount for optics or other devices. Yet, the location over the dust cover may be a desirable location for an optics mount.

Also, none show interchangeable optics that are supported by a base platform that replaces a rear sight tower in a Kalashnikov style firearm.

Further, none show a platform with a slide rail that slidingly and removably holds a removable module along a slide rail longitudinal axis.

Still further, none show a slide retention feature of the present invention that supports the module and the gas tube of the firearm.

Thus there exists a need for an optics assembly having a platform and removable and interchangeable modules that solves these and other problems.

SUMMARY OF THE INVENTION

The present invention relates to an optics assembly having a base with a platform and removable and interchangeable modules, and in particular to an optics assembly for a Kalashnikov style firearm. In one embodiment, the assembly has two ends with a longitudinal axis there between. The base replaces the rear sight tower of the Kalashnikov style firearm. The base has a platform with edges overhanging relieved areas or slots. The base has a head with holes there through. Modules can be removably received upon the base. Each module has at least one mount for supporting an optic. Each module has ears that straddle the base head. The ears have holes that are alignable with the head holes for receiving a pin. The modules have ribs that are received within slots in the base as the module is slid along the longitudinal axis relative the base.

According to one advantage of the present invention, the assembly is specifically designed for use with a Kalashnikov style firearm. This is accomplished in the present invention by having a base that replaces the firearm rear sight tower. This specific location on the firearm is strong and capable of supporting the assembly of the present invention.

In several embodiments, the user is able to select the location along the longitudinal axis of the module upon which to secure the optics. Such flexibility is especially true with elongated modules. This advantageously allows the user to select the desired location, even locations relative the firearm wherein direct support would be unsatisfactory (such as being supported by the dust cover).

In elongated module embodiments wherein the user can support optics over the dust cover, the present invention advantageously allows the user to remove the dust cover without removing the module. Further, the Kalashnikov firearm can be field-stripped with the base and a module in place.

In another embodiment, given that elongated modules are provided, the user can mount two or even more optics upon the same module. For example, one optic can be mounted on the top of the firearm, and another can be, for example, offset at 45 degrees. This allows for multiple optics serving different purposes to be used with the present invention.

According to another advantage of the present invention, the modules are removably supported on a base platform. The base platform avoids heat from direct contact with the warmest portions of the gas tube, as the warmest portions of the gas tube are remote from the base. Supporting the optics away from heat sources is desirable as some types of optics are prone to failure at elevated temperatures.

According to a further advantage of the present invention, the module is slidingly supported by the base along the assembly longitudinal axis.

Related, and according to another advantage of the present invention, a pin is provided as a slide retention feature. The module is secured to the base with the gas tube release pin. The pin prevents the module from moving relative the base along the longitudinal axis.

According to a still further advantage of the present invention, the base is rigidly fixed to the firearm, and the module is removably yet rigidly connectable to the base in the same location every each module is re-connected to the base. In this regard, the modules can be quickly interchanged without the need to re-zero the optics each time that the module containing the specific optic is reconnected to the base.

Other advantages, benefits, and features of the present invention will become apparent to those skilled in the art upon reading the detailed description of the invention and studying the drawings.

DETAILED DESCRIPTION OF PREFERRED EMBODIMENTS

Figure 1:
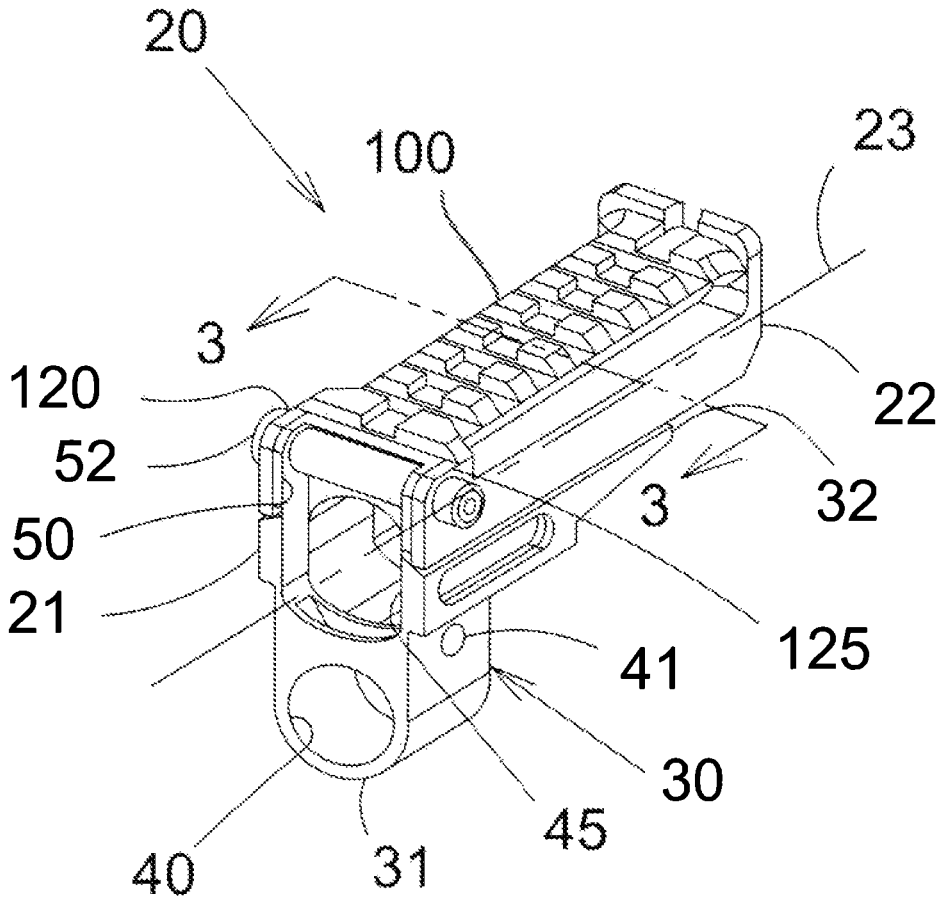
FIG. 1 is a perspective view of a preferred embodiment of the present invention.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is useful with a Kalashnikov style firearm 10. The firearm 10 has a main body 11, a barrel 12, a gas tube 13, a gun stock 14 and a dust cover 15. The assembly 20 of the present invention is a replacement for a rear sight tower in Kalashnikov style firearms. In this regard, the rear sight tower is removed from the firearm 10 and the present invention is installed on the firearm in its place.

Turning now to the present invention, it is seen that an assembly 20 is provided. The assembly 20 has a first end 21 and an opposed second end 22. The ends 21 and 22 are on longitudinal ends of the assembly 20. The assembly 20 has a longitudinal axis 23.

The assembly 20 has a base 30 and at least one removable module 100. Several modules 100, 150, 200, 250 and 300 are illustrated. Yet, it is appreciated that these modules are exemplary only, and that other modules may be used without departing from the broad aspects of the present invention. The assembly is preferably made of strong, rigid and thermally stable materials such as metal. Yet, other materials having suitable properties may be utilized without departing from the broad aspects of the present invention.

The base 30 is best seen in FIGS. 1-5 and 15-20. The base 30 has opposed longitudinal ends 31 and 32, a top 33, a bottom 34, a first side 35 and a second side 36. A barrel ring 40 is preferably located at the first end 31 at the bottom 34 of the base 30. The barrel ring 40 has a hole 41 on one of its sides that is oriented laterally through the ring 40 sidewall. A gas tube port 45 is also provided. The base 30 further has a head 50 with holes 51 for receiving a pin 52. Holes 51 are located at the same location that holes are located on a tradition rear sight tower. In this regard, the pin 52 acts in the traditional sense to lock the gas tube in place within the firearm.

The base 30 also has a platform 60. The platform 60 has edges 61 and 62. Edges 61 and 62 are preferably parallel to each other and parallel to the assembly longitudinal axis 23. The edges 61 and 62 extend over slots 63 and 64, respectively. The slots are parallel to each other and are preferably open to the rear of the base 30.

Each side 35 and 36 has a cavity formed therein. The cavities are provided for weight reduction.

The base 30 is secured to the firearm 10 by the barrel ring 40 surrounding the barrel 12 of the firearm 10, and also by a pin 18 passing through the hole 41 in the ring 40. In this regard, the base 30 is rigidly connected to the firearm 10 and provides a solid foundation upon which items can be connected to.

Figure 2:
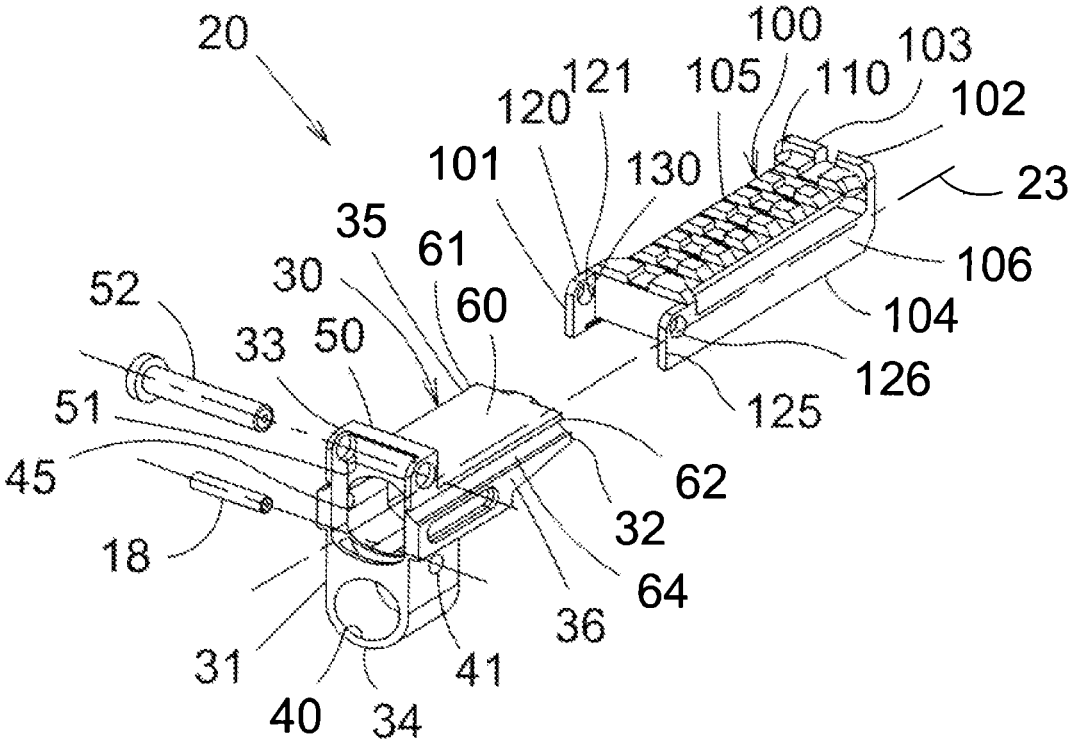
FIG. 2 is an exploded view of the embodiment illustrated in FIG. 1.
Figure 3:
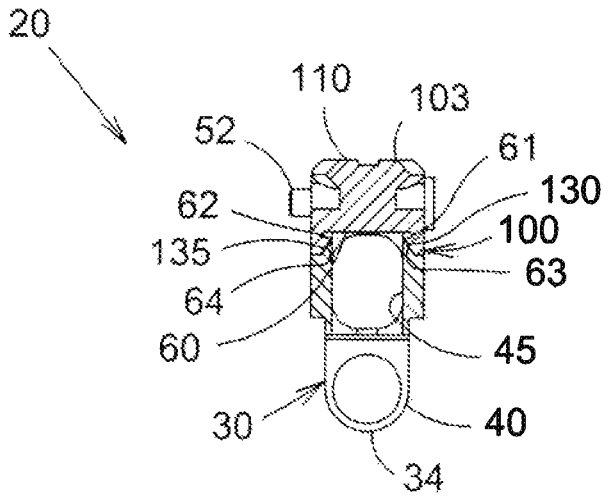
FIG. 3 is a cross-sectional view taken along line 3-3 in FIG. 1.

Looking now to FIGS. 1-3, it is seen that a first module 100 is provided. The module 100 has a first end 101, a second end 102, a top 103, a bottom 104, a first side 105 and a second side 106.

A mount 110 is provided. In this embodiment, the mount 110 is a short Picatinny rail.

The module 100 further has two ears 120 and 125. Ear 120 has a hole 121 there through. Ear 125 has a hole 126 there through.

Ribs (or rails) 130 and 135 are also provided. The ribs 130 and 135 are on inside surfaces of the module 100 below the mount 110. The ribs are parallel to each other. Each rib has a flat top surface and an angled outer wall surface. These surfaces mate with and are in close contact with the slot surfaces.

The module 100 is removably connected to the base 30. In this regard, the ribs 130 and 135 slidingly mate with slots 63 and 64 respectively. In this regard, the slot and ribbed engagement ensures that the longitudinal axis of the base is parallel to the longitudinal axis of the module. Ear holes 121 and 126 are aligned with head holes 51 when the module 100 is fully received upon the base 30. Then the pin 52 can be inserted through the holes to fix the module 100 in longitudinal position relative the base 30.

The module 100 is removable from the firearm 10 in the opposite manner. In this regard, the pin 52 is first removed from the holes, and then the module is slid off of the base in a direction rearward along the assembly longitudinal axis 23.

The firearm can be field stripped while the base 30 and module 100 are in place upon the firearm.

Figure 4:
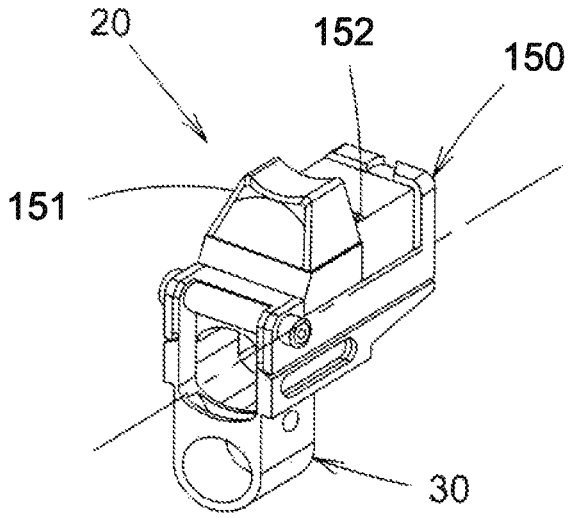
FIG. 4 is a perspective view showing an alternative preferred module of the present invention.
Figure 5:
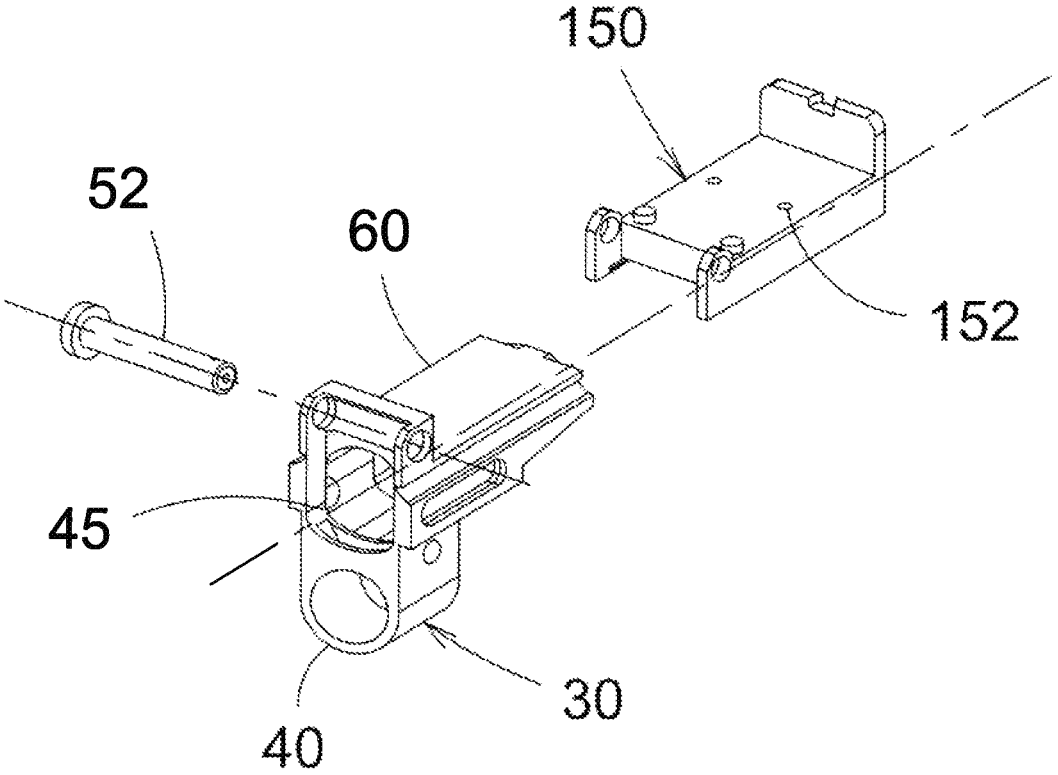
FIG. 5 is an exploded view of the embodiment illustrated in FIG. 4, but without an optic mounted to the mount.

Turning now to FIGS. 4-5, it is seen that an alternative module 150 is provided. The module 150 is designed to accommodate a Red Dot sight 151. In this regard, the sight 151 can be secured to the module 150 with screws that are received within screw holes 152 in the top of the module.

Figure 6:
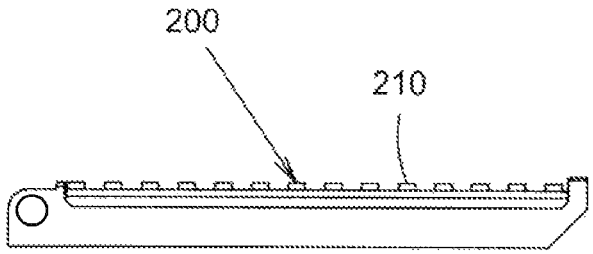
FIG. 6 is a side view showing a further alternative preferred embodiment of the present invention.
Figure 7:
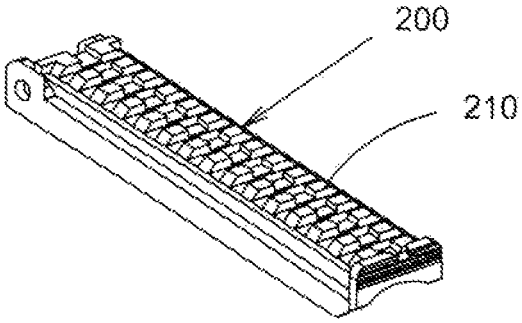
FIG. 7 is a perspective view of the embodiment illustrated in FIG. 6.
Figure 8:
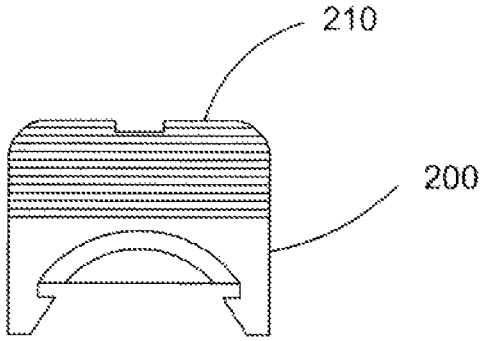
FIG. 8 is an end view of the embodiment illustrated in FIG. 6.

Turning now to FIGS. 6-8, it is seen that a further alternative embodiment of a module 200 is provided. The module 200 has an elongated rail mount 210. The elongated rail mount can have a length of about 7 inches, although it could be longer or shorter without departing from the broad aspects of the present invention. The mount has a length between the two ends that is greater than the length of the base. In this regard, since the front end of the module 200 is fixed by pin 52, it is apparent that the rear of the module 200 extends rearward on the firearm behind the second end 32 of the base 30. This allows optics to be mounted over the dust cover, yet supported by the base that is connected to the main body of the firearm. As seen in FIGS. 7 and 8, it is illustrated that bottom side of the module is relieved so that it will clear the dust cover. The relieved area is apparent at the remote end (at rear of module and opposite of connecting end) of the module.

Figure 9:
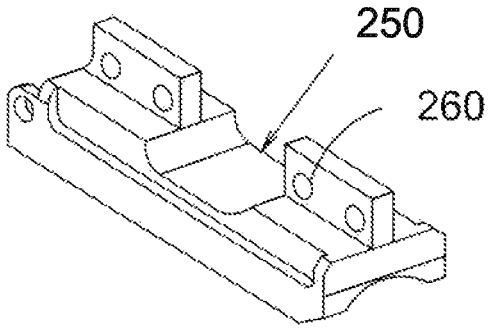
FIG. 9 is a perspective view of yet another preferred module of the present invention.
Figure 10:
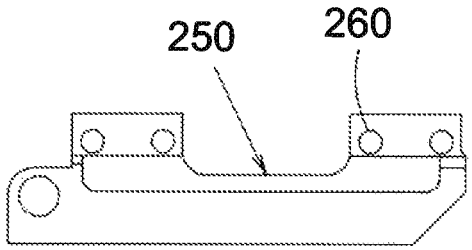
FIG. 10 is a side view of the embodiment illustrated in FIG. 9.
Figure 11:
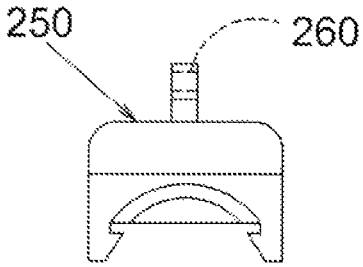
FIG. 11 is an end view of the embodiment illustrated in FIG. 9.

Turning now to FIGS. 9-11, it is seen that an even further embodiment of a module 250 is illustrated. In this embodiment, the module is designed to accommodate scope mounts. Clamps can be provided for being received in the scope mount holes 260 of the module 250. It is preferred that two holes are in the front, and two in the rear of the module in order to accommodate the front and rear clamps of the mount. FIGS. 9 and 11 show the bottom side relieved to allow clearance over the dust cover of the firearm and wherein the relieved area is open to the back or remote end of the module.

Figure 12:
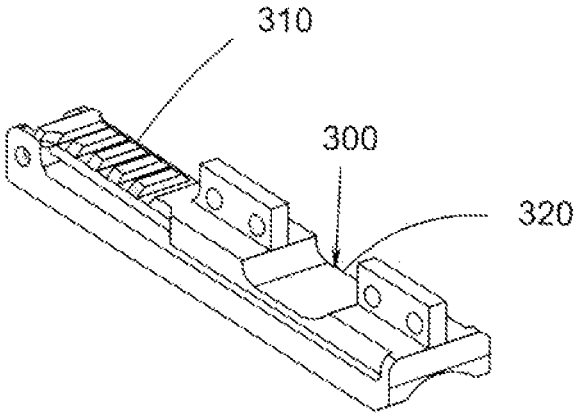
FIG. 12 is a perspective view of yet another preferred module of the present invention.
Figure 13:
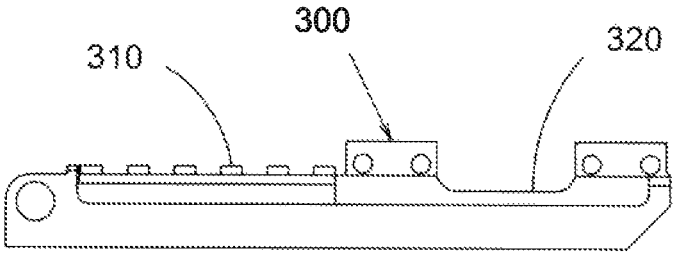
FIG. 13 is a side view of the embodiment illustrated in FIG. 12.
Figure 14:
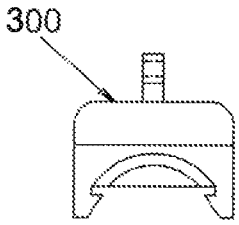
FIG. 14 is an end view of the embodiment illustrated in FIG. 12.
Figure 15:
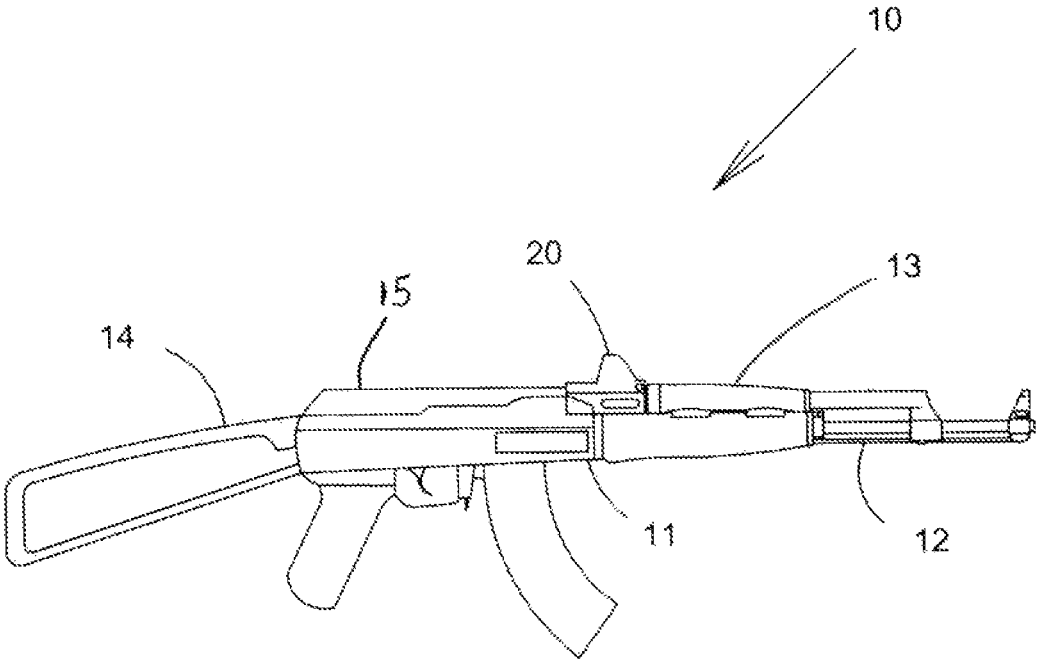
FIG. 15 is a view of a firearm with the assembly of the present invention mounted thereon.
Figure 16:
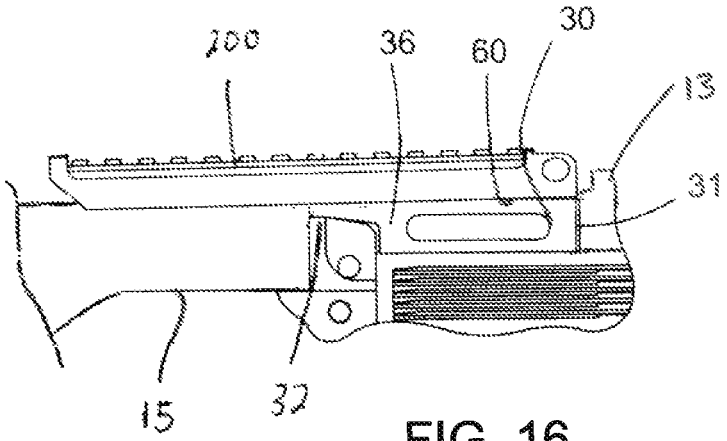
FIG. 16 is a close-up lower perspective view of the base of the present invention secured to a firearm with a module extending over the dust cover.
Figure 17:
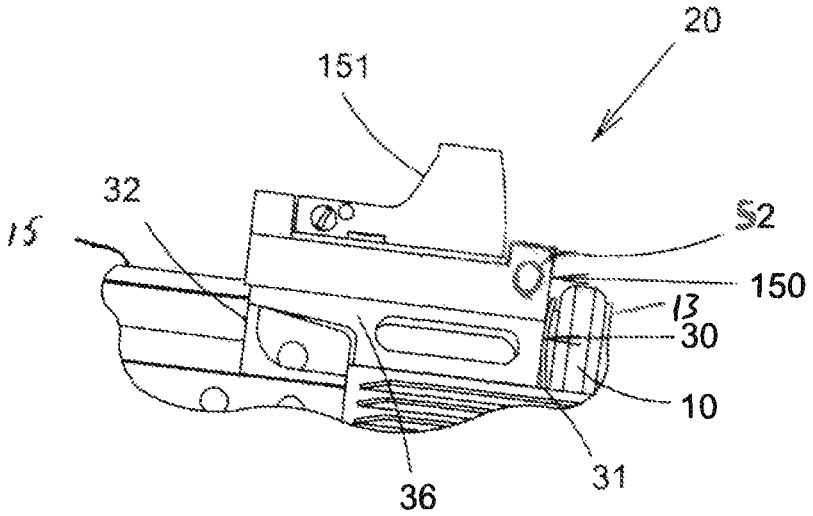
FIG. 17 is similar to FIG. 16, but shows a preferred module removably connected to the base.
Figure 18:
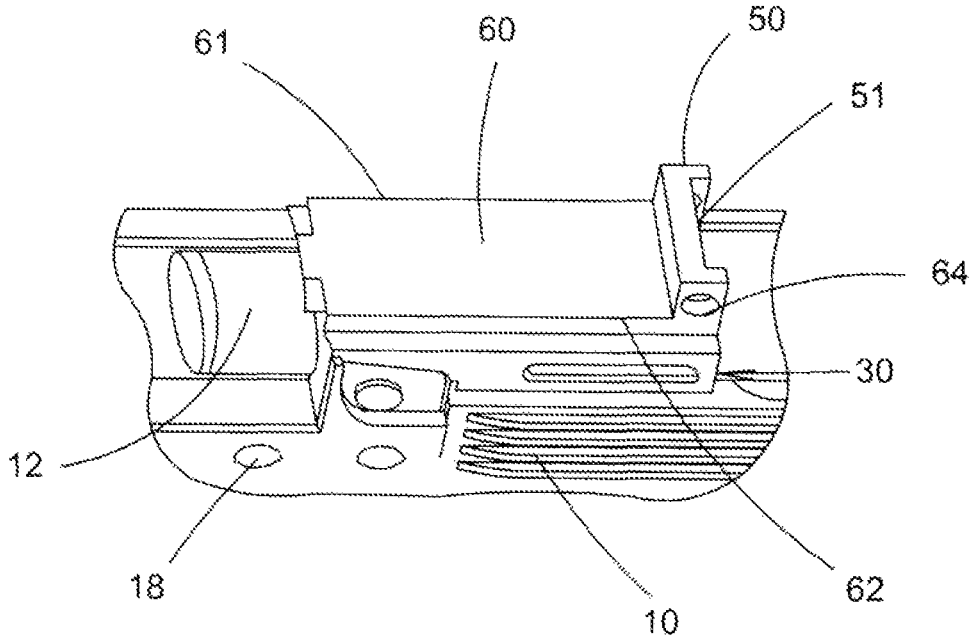
FIG. 18 is a close-up upper perspective view of the base of the present invention secured to a firearm.
Figure 19:
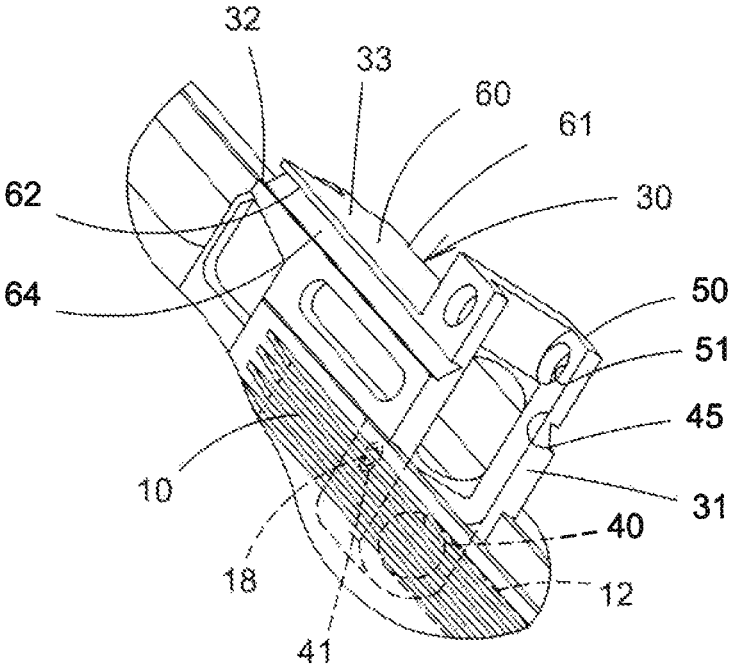
FIG. 19 is a close-up front perspective view of the base of the present invention secured to a firearm.
Figure 20:
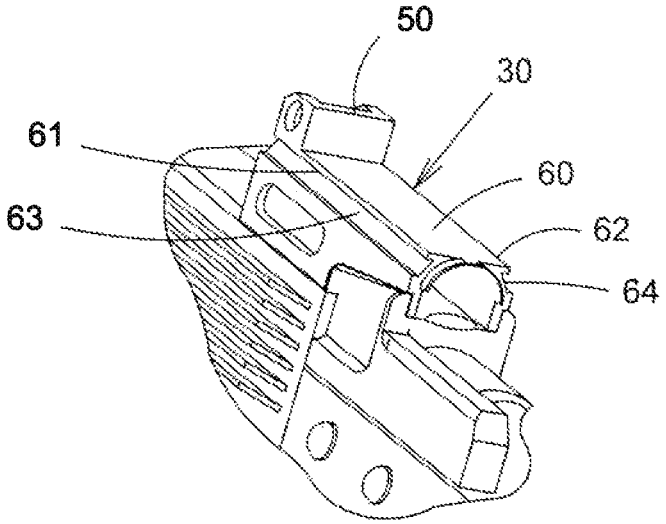
FIG. 20 is a close-up rear perspective view of the base of the present invention secured to a firearm.

Turning now to FIGS. 12-14, an additional illustrated embodiment of a module 300 is illustrated. The module 300 has a mount first section 310 at the front of the module, and a mount second section 320 at the rear of the module. The bottom side of the module is relieved as shown in FIGS. 12 and 14 to clear a dust cover of the firearm. Two preferred types of mounts are a rail and a scope mount. Yet, it is appreciated that other types of mounts may be used without departing from the broad aspects of the present invention. Also, it is appreciated that more than two types of mounts may be included without departing from the broad aspects of the present invention.

It is appreciated that with an elongated module having multiple mount types, it is possible to mount multiple optics simultaneously on a Kalashnikov style firearm. This can be accomplished by securing a scope to the scope mounts, and a 45 degree Red Dot sight to the Picatinny rail.

It is appreciated that each of the illustrated modules is connected to and removed from the base in the same manner.

Thus it is apparent that there has been provided, in accordance with the invention, an optics assembly having a platform and removable and interchangeable modules that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An assembly for a firearm, said assembly comprising:

a base connected to the firearm replacing a rear sight tower of a Kalashnikov style firearm, said base having a platform;

a module that is removably connected to said base;

wherein said platform has a first side and a second side, said first side being generally parallel to said second side, a slot being formed on at least one of said first side and said second side wherein said module is slidable relative to said platform within said slot;

wherein said base has a head upstanding from said platform;

wherein said head has a first head hole and a second head hole there through that are aligned to receive a pin; and wherein said module comprises a first ear with a first ear hole and a second ear with a second ear hole, said first ear hole and said second ear hole being alignable with said first head hole and said second head hole.

2. The assembly of claim 1 wherein said platform comprises a first slot on said first side and a second slot on said second side, said first side having a first side edge extending over said first slot and said second side having a second side edge extending over said second slot.

3. The assembly of claim 2 wherein said module comprises a first rib and a second rib, said first rib engaging said first slot and said second rib engaging said second slot whereby said module is slideable relative said base.

4. The assembly of claim 1 wherein said base comprises a barrel ring.

5. The assembly of claim wherein a barrel ring hole is formed through said barrel ring to receive a pin to rigidly mount said base to the firearm.

6. The assembly of claim 1 wherein said module comprises a mount with at least one mount section.

7. The assembly of claim 6 wherein said module comprises a mount first section and a mount second section.

8. The assembly of claim 1 wherein:

said base has a base first end and a base second end;

said module has a module first end and a module second end;

said module being connected to said base at said base first end and said module first end.

9. The assembly of claim 8 wherein said module second end extends beyond said base second end.

10. An assembly for a firearm, said assembly comprising:

an assembly longitudinal axis;

a base connected to the firearm replacing a rear sight tower of a Kalashnikov style firearm having:

a platform;

at least one slot generally parallel to said assembly longitudinal axis;

a barrel ring connecting said base to the firearm;

a module that is removably connected to said base, said module being slidably connected to said platform within said at least one slot;

wherein said base has a head upstanding from said platform;

wherein said head has a first head hole and a second head hole there through that are aligned to receive a pin; and wherein said module comprises a first ear with a first ear hole and a second ear with a second ear hole, said first ear hole and said second ear hole being alignable with said first head hole and said second head hole.

11. The assembly of claim 10 wherein a barrel ring hole is formed through said barrel ring to receive a pin.

12. The assembly of claim 10 wherein said pin holding said module relative said base.

13. The assembly of claim 10 wherein said module comprises at least one rib, said at least one rib engaging said at least one slot of said base whereby said module is movable relative said base in a direction generally parallel to said assembly longitudinal axis.

14. A method of attaching a module to a base connected to a firearm, said method comprising the steps:

providing a firearm with a barrel;

providing a base connected to the firearm replacing a rear sight tower of a Kalashnikov style firearm having:

a first base slot and a second base slot;

a barrel ring; and a platform;

connecting the base to the firearm via the barrel ring;

providing a module with a first module rib and a second module rib;

attaching the module to the base by engaging the first module rib within the first base slot and engaging the second module rib within the second base slot wherein the module is slidably connected to the platform; and providing said base with a head upstanding from said platform;

providing said head with a first head hole and a second head hole there through that are aligned to receive a pin; and providing said module with a first ear with a first ear hole and a second ear with a second ear hole, said first ear hole and said second ear hole being alignable with said first head hole and said second head hole.

15. The method of claim 14 wherein:

the step of providing a module further comprises the steps of providing a mount;

and the step of attaching the module to the platform comprises the step of connecting the first ear and the second ear of the module to the head of the platform, which results in the mount extending beyond the base.

* * * * *